US005168599A

United States Patent [19]

Williams

[11] Patent Number: 5,168,599

[45] Date of Patent: Dec. 8, 1992

[54] WET AND/OR DRY VACUUM CLEANING UNIT

[76] Inventor: William H. Williams, 4938 Golden Arrow Dr., Rancho Palos Verdes, Calif. 90274

[21] Appl. No.: 730,202

[22] Filed: Jul. 15, 1991

Related U.S. Application Data

[63] Continuation-in-part of Ser. No. 444,417, Dec. 1, 1989, abandoned.

[51] Int. Cl.[5] ..... A47L 5/00

[52] U.S. Cl. ..... 15/346; 15/320; 15/387; 15/419

[58] Field of Search ..... 15/345, 346, 387, 353, 15/320-322, 350, 351, 419, 328; 137/38, 45, 46; 251/294, 298

[56] References Cited

U.S. PATENT DOCUMENTS

| | | | |
|---|---|---|---|
| 1,026,104 | 5/1912 | Moorhead | 137/38 X |
| 1,033,164 | 7/1912 | Fahrney | 15/346 |
| 1,059,136 | 4/1913 | Gafney | 15/321 |
| 1,211,902 | 1/1917 | Warner | 15/346 |
| 2,143,845 | 1/1939 | Epstrom | 137/45 X |
| 2,224,202 | 12/1940 | Smellie | 15/346 |
| 2,237,830 | 4/1941 | Jerome | 15/320 |
| 2,331,692 | 10/1943 | Hunt | 15/345 X |
| 2,409,008 | 10/1946 | Acheson | 15/419 X |
| 2,683,276 | 7/1954 | Olsen | 15/387 |
| 2,963,270 | 12/1960 | Magarian | 15/387 X |
| 3,019,462 | 2/1962 | Nash et al. | 15/419 X |
| 3,029,461 | 4/1972 | Osborn | 15/350 |
| 3,065,489 | 11/1962 | Wright | 15/353 |
| 3,964,925 | 6/1976 | Burgoon | 15/321 X |
| 4,023,233 | 5/1977 | Prestwich | 15/320 |
| 4,035,176 | 12/1981 | Lessig, III et al. | 15/387 X |
| 4,204,298 | 5/1980 | Handa et al. | 15/346 X |
| 4,231,133 | 11/1980 | Probost | 15/353 X |
| 4,654,925 | 4/1987 | Grave | 15/322 |
| 4,686,735 | 8/1987 | Soeffker et al. | 15/320 |
| 4,696,075 | 9/1987 | Grave | 15/321 |
| 4,817,233 | 4/1989 | Waldhauser | 15/320 |

FOREIGN PATENT DOCUMENTS

| | | | |
|---|---|---|---|
| 0977910 | 11/1975 | Canada | 15/346 |
| 0021435 | 1/1981 | European Pat. Off. . | |
| 1385414 | 1/1967 | France | 15/346 |
| 4131358 | 10/1979 | Japan . | |
| 1-308513 | 12/1989 | Japan . | |
| 0147109 | 9/1954 | Sweden | 15/345 |
| 2138280 | 10/1984 | United Kingdom | 15/346 |
| 2211227 | 6/1989 | United Kingdom | 15/346 |

*Primary Examiner*—Ernest G. Cusick
*Assistant Examiner*—Casey Jacyna
*Attorney, Agent, or Firm*—Joseph E. Mueth

[57] ABSTRACT

A vacuum system having a closed air flow loop for cleaning rugs and floor or other surfaces. There is a vacuum source having a suction side and a controlled air flow pressure side (exhaust side). A head assembly is adapted to ride on the rug or floor or other surface to be cleaned. At least one rotatable brush is positioned within the head assembly. The suction side of the vacuum source communicates with the head assembly to provide suction within the head assembly for picking up dirt or other materials. The air exhaust side of the vacuum source communicates with the head assembly. A turbine motor is positioned so that the air exhaust from the vacuum source impinges on and drives the turbine motor. The brush and the turbine motor are interconnected whereby the turbine motor drives the brush. The means interconnecting is at a right angle to the axis of rotation of the brush. Peripheral air containment means associated with said head assembly are present to prevent air from entering or leaving around the periphery of the head assembly when it rides on the surface to be cleaned. The device may also have a closed loop for cleaning liquid to continuously recirculate.

22 Claims, 12 Drawing Sheets

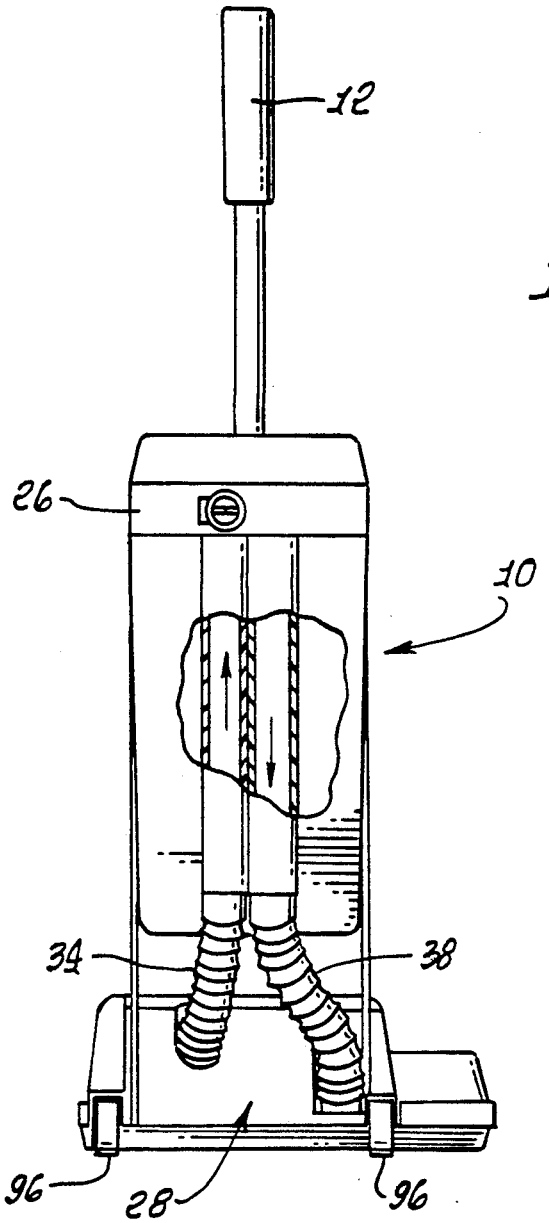
FIG. 3.
FIG. 6.
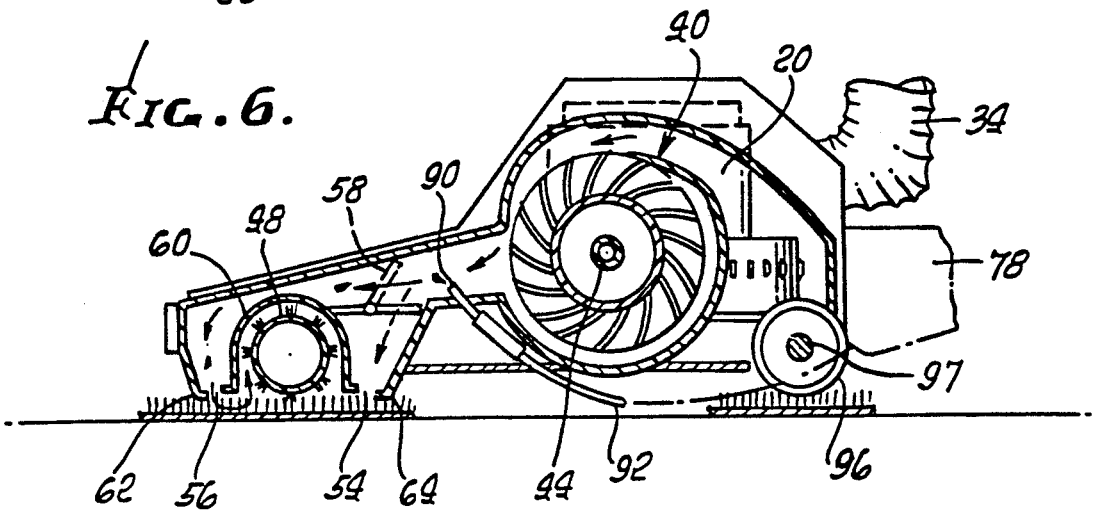

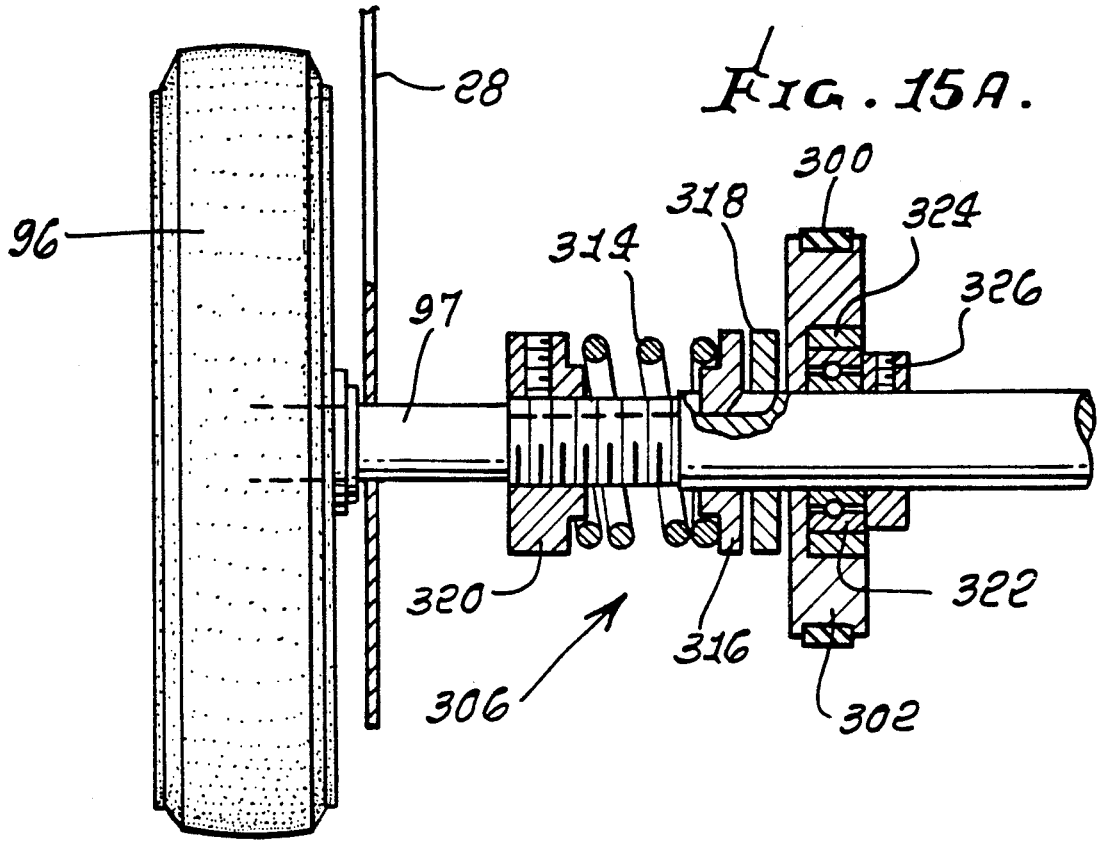
FIG. 15A.
FIG. 18.
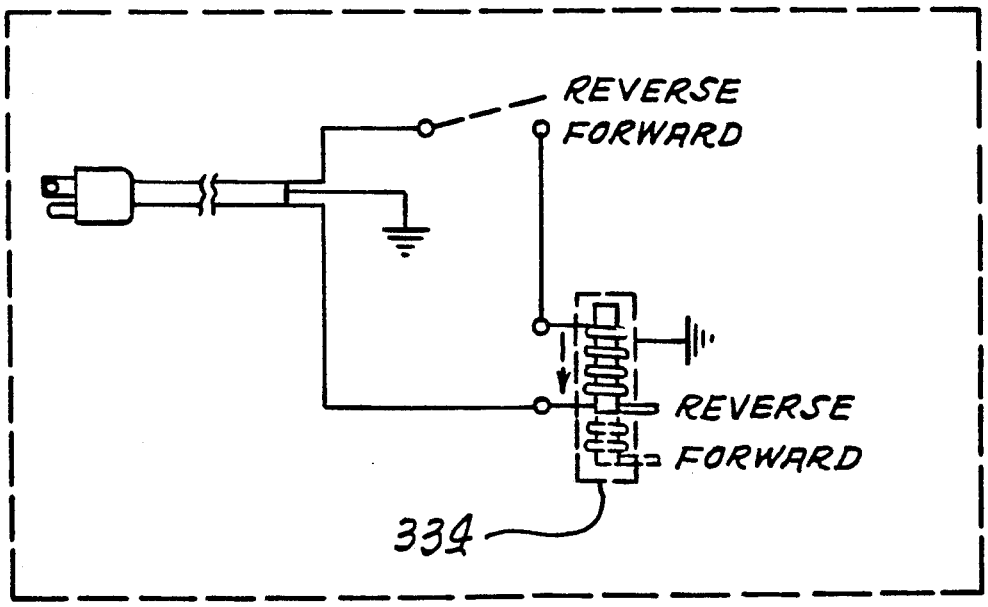

WET AND/OR DRY VACUUM CLEANING UNIT

This Application is a continuation-in-part of U.S. patent application Ser. No. 444,417, filed Dec. 1, 1989.

BACKGROUND OF THE INVENTION

DEFINITIONS

For purposes of explanation and to differentiate between work forces utilized in the described air flow work system, and as it is intended in this patent where the air flow energy or force is used for either pulling or pushing work, the following explanation is given:

AIR FLOW PULLING WORK

Where the vacuum motor is sucking or pulling the air, sometimes referred to herein as the uplink side.

AIR FLOW PUSHING WORK

Where the vacuum motor is blowing or pushing the exhaust air, sometimes referred to herein as the return loop side.

The vacuum cleaning unit with a novel multi-purpose air flow work system of this invention is adapted to be constructed as a wet and/or dry vacuum cleaning unit for cleaning carpets, hard floors, upholstery, et cetera. The novel system may be constructed as a multi-purpose unit to perform all of the cleaning functions mentioned in a single unit, or it may be constructed to perform each individual cleaning function as a single unit, or it may be constructed to perform any combination thereof in a single unit. The novel design features of the cleaning unit of this invention provides important advantages over the devices of the prior art.

The design of the novel cleaning unit of this invention is a multi-purpose air flow work system, in that it moves dirt and other foreign matter by suction from the surface being cleaned through a filter. The resulting used clean filtered air is kept contained and then routed back to perform other work functions.

This returning clean high velocity air flow is used in aiding the cleaning cycle by air jetting and loosening and moving dirt and foreign matter, then blowing it in the direction of the power brush with its air section/uptake opening. In this way, the dirt-laden air is moved upward to the filter where the air flow begins its cycle all over again, as opposed to the conventional method of the prior art, where the air flow is expelled into the atmosphere without further use, with the disadvantage of expelling and depositing fine dust and possible bacteria everywhere, the amount depending on the efficiency of the filter being used.

Yet another important advantage of the system of the present invention is the elimination of the necessary dusting afterward, and most important, in areas such as hospitals and convalescent homes, where the dust and bacteria factor is of extreme importance, is to provide a germ and bacterial killing system where germicidal and bacterial compounds can be used in a continuous closed loop manner, without blowing the germs and bacterial into the atmosphere as with conventional prior art vacuum cleaners or specialized units with costly submicron hospital grade (HEPA) filters which greatly obstruct the airflow and the efficiency of the vacuum motors and in turn the efficiency of the cleaning process.

An additional benefit is the extensive vac-motor noise reduction due to the recycled air flow system. The air fan noise is much more contained and diffused during the internal air flow rerouting process, and is much less noisy that conventional prior art units.

The present novel system also affords greatly improved art in the application of air driven motors for the specific use of vacuum cleaning units through unique placement of the air-driven motor in the multi-purpose air flow work system.

The present invention provides for the efficient use of the multi-purpose air flow work system, in that it reuses the "clean" air from the filter to perform other useful work functions in a continuous manner, instead of being discharged into the atmosphere, as with conventional vacuum cleaning units.

These work functions are, but are not limited to, the following:

1. Driving an air-driven motor in a greatly improved method, as described in greater detail hereinbelow.
2. Driving a venturi and pressurizing the liquid dispensing chamber in a highly efficient manner, as described in detail hereinbelow.
3. Greatly improved agitation and cleaning action, as described hereinbelow.

The configuration of this air flow work system may include one or more rotary or oscillating power-driven brush assemblies to aid in the loosening and removal of dirt and foreign matter. These brush assemblies may be driven by electrical means, or may be driven by an air-driven motor.

In the case of utilizing an air-driven motor to power a brush assembly in a vacuum cleaner, the design feature is to provide a clean air flow to the brush turbine motor. This is accomplished by according to my invention by using the vacuum motor air flow after it has passed through the filter. This clean filtered air is then routed to efficiently drive the brush turbine motor in a continuous manner.

One important disadvantage of the prior art is that it does not include an air flow system which delivers clean, filtered air to power the brush turbine motor. The prior art places the air driven motor in the vacuum line up-link prior to filtering and must continuously process all dust, dirt and debris, such as cigarette butts, toothpicks, paper clips and the like in the vacuumed air flow on its way to the filter. The prior art vacuum cleaners with air-driven motors have never become popular because of having to consume all of the above-mentioned dirt and debris, with the resultant nuisance of continuously having to stop the cleaning process to clear the obstructed air motor, as well as the associated high maintenance and repair.

The configuration of the novel cleaning unit with the multi-purpose air flow work system includes a venturi for the dispensing of cleaning solutions when it is in the wet working mode. The design feature of the venturi is that the Venturi is positioned in the clean air return loop past the filter, and after the dirt-laden air and cleaning solution have been cleaned by the filtering system, thereby keeping the venturi from fouling or plugging up.

The additional benefit is that the re-routed high velocity air flow over the venturi tube pulls a low volume of liquid which "atomizes" the liquid cleaning solution, which then is air-jetted to the surface to be cleaned as "wet air" instead of a stream of water. This eliminates the problem of over-wetting, as with conventional prior art carpet cleaning extraction units equipped with pumps and spray nozzles, with resulting long and bothersome drying time and the possibility of mildew and material rot.

Still further, it simplifies and reduces the cost of moving liquid, as it does not require the use of a costly pump to accomplish this task.

The configuration of this cleaning unit also includes a controlled release system to dispense the cleaning liquid at will, in a metered manner when it is in the wet floor or carpet cleaning mode.

The filtered air return channel to the work head includes part of the liquid dispensing valve, in that it closes the clean liquid chamber while it opens a side passage to the main return air flow channel, and thereby pressurizes the chamber containing the cleaning liquid, while at the same time opening the valve to the venturi. The liquid dispensing chamber pressurization efficiently assists the venturi in dispensing the cleaning solution.

The configuration of this cleaning unit with the multipurpose air flow work system design can include an air pressure and flow regulator valve, in case of a major momentary air flow restriction in the unit uplink suction part of the air flow system. The valve is placed past the filter unit, and just before the vacuum motor or motors, to eliminate possible airflow/starvation and to insure the delivery air flow system in the following special manner:

With the single brush configuration, the air and dirt is sucked up into the brush assembly opening, and up and through the filter assembly. The filtered clean air is then returned to the work head where it may drive an air-driven motor which powers the work head brush assembly. The air is then routed through elongated narrow openings in the front and back of the brush assembly opening, where the high velocity air flow is then used in aiding the cleaning cycle by air jetting and loosening and moving dirt and foreign matter in the direction of the agitating brush, suction and uptake opening, which in turn moves the delivered air and dirt again upward through the filter, where the air flow begins to cycle all over again in a continuous manner, where the novel combination of the simultaneous air jetting, brush agitation and air suction is providing a much superior combined agitation and cleaning action than is provided in prior art conventional units.

In addition, the air jet flow may be controlled by the optional valving to jet out only in the direction that the work head moves.

As an example:

When the work head is pushed forward, the air flow will only jet out of the front opening with the back opening being closed, and with the work head traveling toward the air flow with the air flow always pointed toward the approaching agitating brush and vacuum opening, where the air jet and brush agitation work together in an efficient manner.

When the work head is pulled backward, the automatic air flow valve reverses the process by which it closes the front air jet opening, and simultaneously opens the back air jet opening with the air flow again pointed toward the approaching brush and vacuum opening.

The added feature of the work head is that the air flow is contained within the workhead with a special peripheral air dams, and the air flow containment is accomplished quite easily with these air dams, since the air flow static pressure within this air dam is at zero (0) due to the air flow quantitative equilibrium at this point, i.e., there is as much air flow coming as going.

The work head in the hard floor wet cleaning can be provided simply with the addition of a clip-on scrubbing pad and the lowering of a self-adjusting or adjustable brush assembly (by electrical or manual means), to the hard floor scrubbing position. The preferred self-adjusting brush assembly is disclosed in applicant's U.S. Pat. No. 4,976,003, issued Dec. 11, 1990. The unique and greatly improved art of hard floor cleaning is accomplished with the combined effort of:

a) cleaning pad scrubbing;

b) heavy brush scrubbing;

c) air jet agitation;

d) pressurized and atomized depositions of cleaning solutions; and e) removal of soiled solution by vacuum method.

Providing a new and greatly improved wet carpet extraction method for wet carpet extraction machines (with or without motor-powered agitation brush assembly).

a) Having an extraction work head, a large and centrally located vacuum uptake opening with air/water jet openings in front and back of the brush assembly and vacuum uptake opening, allowing the extraction workhead to properly function in both directions, forward and backward strokes.

b) Having an extraction workhead with a large centrally located vacuum uptake opening, allowing it to pass large dirt and debris particles, such as cigarette butts, toothpicks, paper clips, and the like.

The prior art conventional wet carpet extraction machines (with or without powered agitation brush assembly), are outfitted with narrow suction openings, specifically designed to move air and cleaning solutions laden with fine dirt only in a high-velocity manner, and are not designed to handle dirt and debris such as cigarette butts, toothpicks, paperclips, et cetera. In addition, these units are designed to move and clean in one direction only, mostly in a pulling movement, since the agitation brush and the cleaning solution spray jets are all mounted behind the narrow vacuum uptake opening, and therefore, the unit will not properly function in a forward movement. It obviously would leave behind all of the deposited cleaning solutions with the loosened dirt.

SUMMARY OF THE INVENTION

In general, the present invention comprehends:

In a vacuum system for cleaning rugs and floors or other surfaces having a vacuum source and means for employing the vacuum generated by the vacuum source for picking up dirt and other material from said rugs, floors or other surfaces, and further where said system includes a rotatable brush which is adapted to agitate and loosen said dirt and other material, the improvement comprising a closed loop which includes using the air flow pressure from the exhaust side of said vacuum source in a contained flow to perform work functions in said system, including the provision of power to drive said rotatable brush.

More particularly, the invention includes a vacuum system for cleaning rugs and floor surfaces or other surfaces which comprises:

a) a vacuum source having a suction side and an air exhaust side;

b) a head assembly adapted to ride on the rug or floor or other surface to be cleaned;

c) at least one rotatable brush within said head assembly;

d) means for communication the suction side of the vacuum source with the head assembly to provide suction within said head assembly for picking up dirt and other materials;

e) a turbine motor;

f) means communicating the exhaust side of the vacuum source with said head assembly, said turbine motor being positioned within said means whereby the exhaust air drives the turbine motor; and g) means interconnecting the brush and the turbine motor whereby the turbine motor drives the brush.

It is a major object of my invention to provide a novel vacuum cleaning system which is adapted to operate in a wet and/or dry mode.

More particularly, it is an object of this invention to provide a novel vacuum cleaning system wherein the dirt and other foreign matter sucked up, is filtered, and the cleaned filtered air is routed or recycled to perform other work functions.

In another aspect, it is an object of this invention to provide a closed loop system wherein air and, if used, fluid, are continuously used, filtered and recycled.

It is further an object of this invention to provide a germ and bacteria killing system for hospitals, convalescent homes and the like, where germicidal and bacterial killing compound can be used in a continuous closed loop manner without blowing the germs and bacteria into the atmosphere.

Another object of this invention is to provide a means for driving the brushes in the head assembly which includes a turbine motor driven by clean filtered air from the exhaust of at least one vacuum motor whereby no solid objects or material can clog or stall the turbine motor.

In the present invention, it is a still further object to agitate dirt and other material to be removed from the dirty surface being vacuumed by the introduction of pressurized air containing atomized liquid, into the head assembly.

These and other objects of my invention will be apparent to those skilled in the art from the following more detailed description, taken with the accompanying drawings.

DESCRIPTION OF PREFERRED EMBODIMENTS

Turning to the drawings:

FIG. 3 is a rear view of the device of FIG. 1.

FIG. 4 shows the device of FIG. 1 with the hand piece shown, in broken lines, rotated 90° to the horizontal position for use under furniture, beds and the like.

FIG. 6 is a sectional view taken along line 6—6 in FIG. 5.

FIG. 15A is a cross-section of the mechanically activated flap valve and related structure of FIG. 14.

FIG. 18 is a schematic electrical diagram of the circuitry involved in the operation of the flap valve of FIG. 16.

Figure 1:
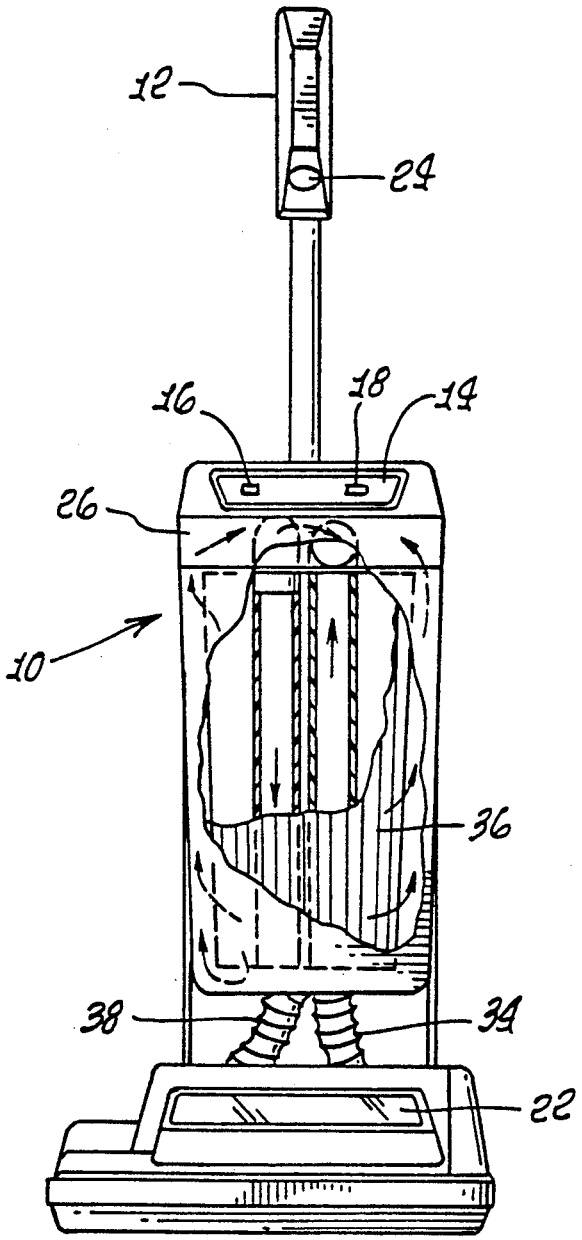
FIG. 1 is a front plan view, partially broken away, of the preferred embodiment of a self-contained upright floor model vacuum cleaner containing the novel system of this invention.
Figure 2:
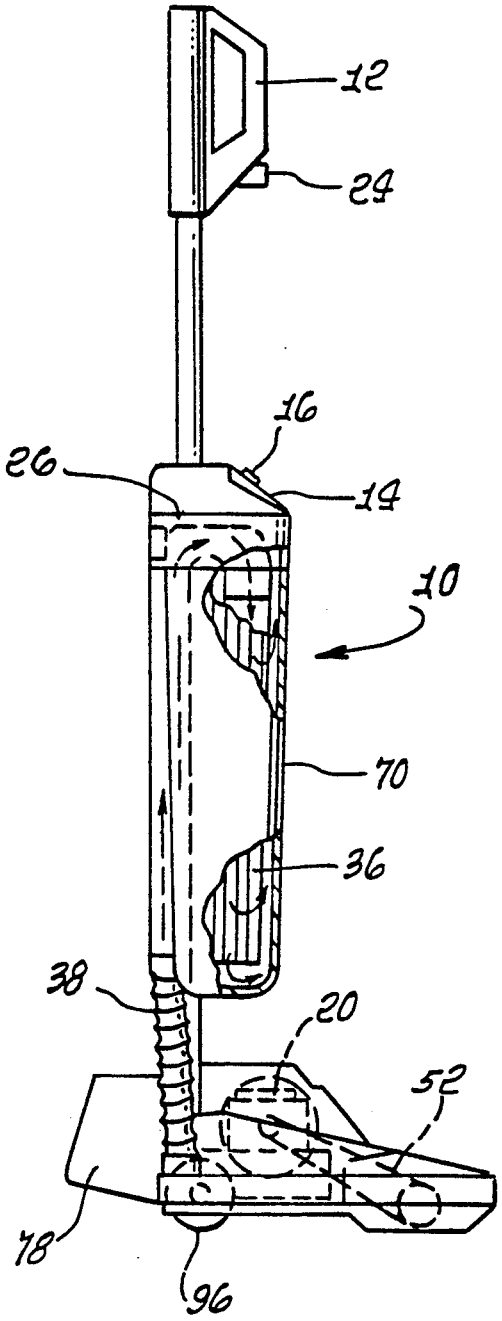
FIG. 2 is a side view of the device of FIG. 1.

Turning to the drawings in greater detail, the upright portion 10 is provided with handle 12, control panel 14 with switches 16 and 18 for operating the vacuum motor(s) 20 and floor light (not shown) which is positioned behind lens 22, respectively. The button 24 on handle 12 controls the dispensing of liquid. The top of upright portion 10 has a hinged lid 26.

Figure 7:
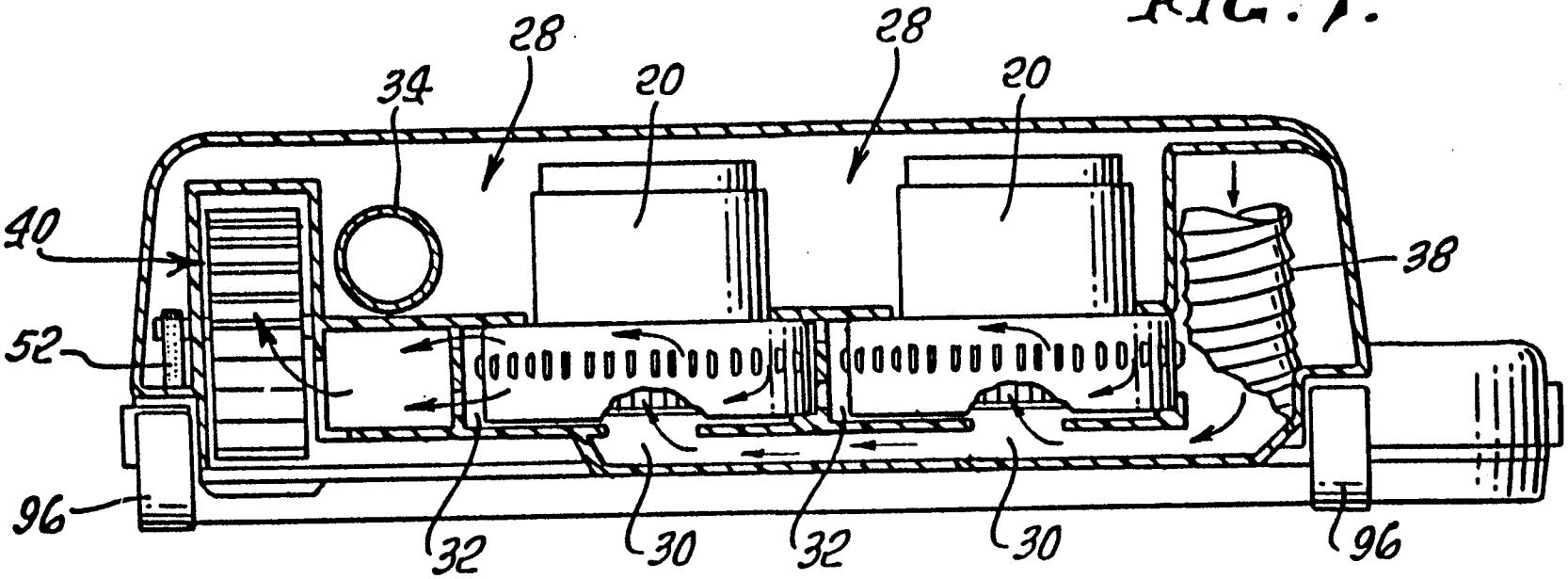
FIG. 7 is a sectional view taken along line 7—7 in FIG. 5.

The lower or head assembly 28, FIG. 7 carries the vacuum motor(s) 2 having suction side 30 and air exhaust side 32. The suction side 30 pulls the dirty air upwardly in uptake line 34 and through the filter assembly 36 and downwardly through suction line 38. The filtered air exhaust side 32 communicates with and impinges on the turbine blade assembly 40 of the air turbine motor 42. The turbine blade assembly 40 is carried by shaft 44, FIG. 5. The shaft 44 has a pulley 46. The brush 48 also has a pulley 50. These pulleys are connected by belt 52 so that the turbine motor 42 rotatably drives the brush 48. Note that the uptake line 34 is centrally located over brush 48 within head assembly 28, so that it can suck up large objects which can enter head assembly through the very large floor-side opening.

The air flow, after passing turbine blade assembly 40, is then injected into the interior of head assembly 28 at both air injection slots 54 and 56 and in the case of the optional flap valve system. If the air jet flow valve 58 is "up" (shown in dotted lines in FIG. 6), all of the air is injected via slot 54. If the valve 58 is "down" (shown in solid lines in FIG. 6), the air is injected via slot 56. The valve position can be automatically alternated with the mechanical or electro-mechanical slip clutch arrangement as shown in FIGS. 14 through 18 so that air injection is always at a point ahead of the brush 48. Using FIG. 6 as an illustration, when the unit is pushed forward by the operator (to the left), air is introduced at slot 56. When the unit is pulled back by the operator, the air is introduced at slot 54. Thus, this structure provides for the injection of clean air (including atomized water in the wet mode) ahead of the brush when the cleaning unit as a whole is either pushed forward or backward. The central location of uptake 34 over the brush 48 also serves to permit back and forth operation.

The interior of housing 60 with inner air dams communicates with line 34 to take up dirty air. The elements 62 and 64 at the periphery are adapted to abut the surface being cleaned to create the outer air dams. In the case of a rug, the elements 62 and 64 slightly depress the nap of the rug to help make the outer air dam. The injection of air into head assembly 28 is balanced by the withdrawal of air toward the center via line 34 so that there is an air flow pressure equilibrium at the peripheral inner air dam of housing 60.

The work head presses on the surface to be cleaned to force the air flow through the carpet tufts with an outer air dam providing greater pressure on the carpet than the slightly higher inner dam, where the inner dam having air flow vacuum pull on one side (center inside) and exhaust air pressure on the other side (outside), thereby forcing the air flow through the carpet tufts underneath the inner dam by controlled pushing and pulling technique resulting in the high air jet agitation and removal of dirt logged deep in the carpet, in addition to the brush agitation. This method also eliminates air pressure on the outer dam seal due to air flow pressure equilibrium at the inner dam, i.e. where there is as much air flow going as coming. The air flow from the inner dam is then sucked up and moves over the brush assembly to start the closed loop air flow cycle all over again.

To this point, the description of the drawings has focussed on the dry mode of operation.

Figure 4:
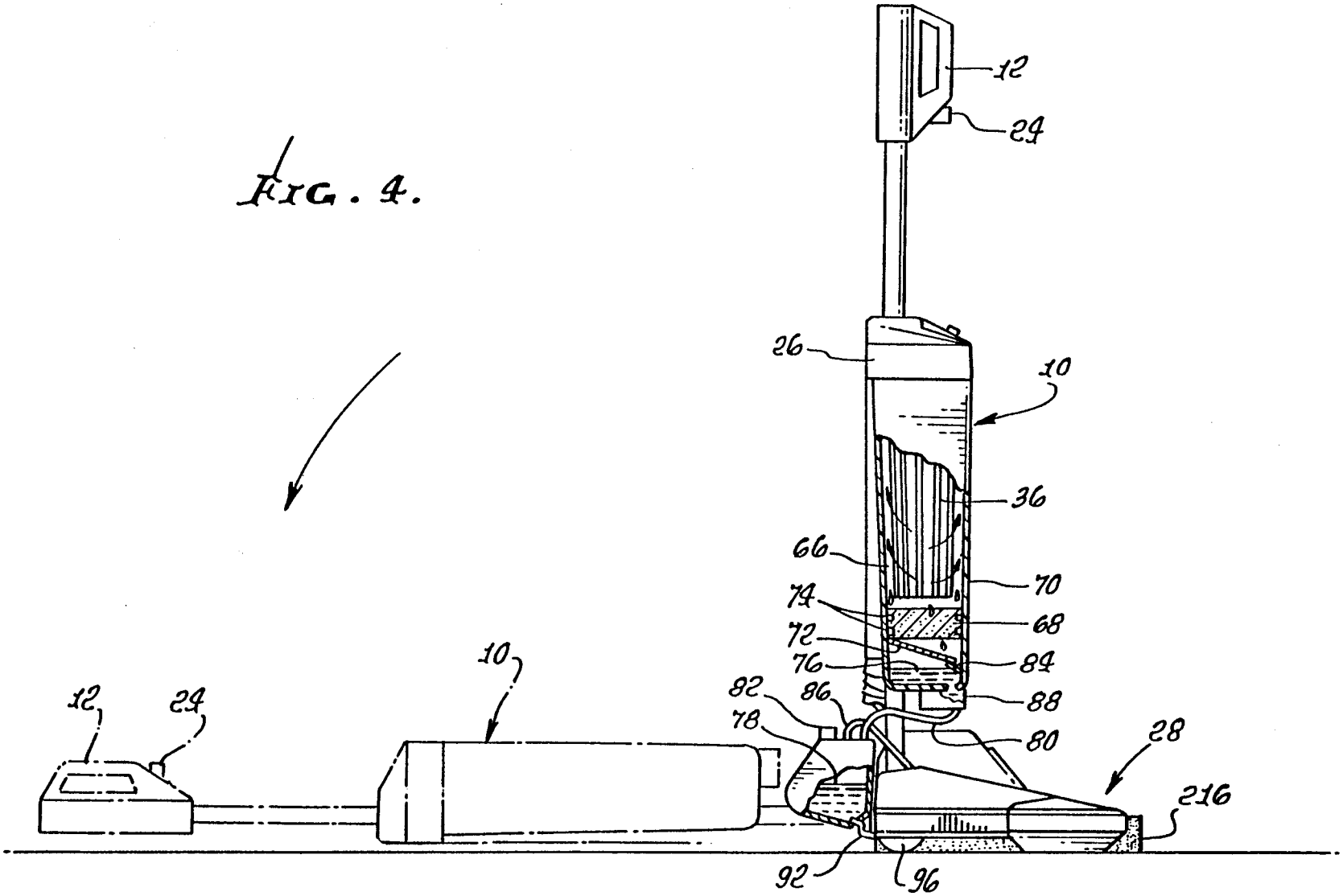
Figure 9A:
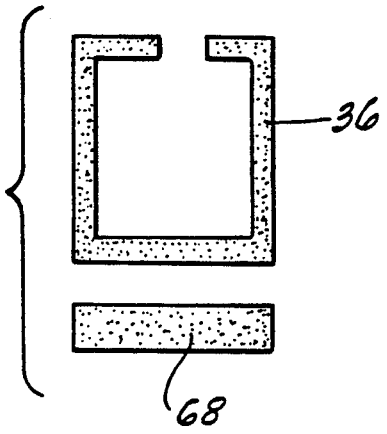
FIG. 9A shows in more detail a wet filter, in sectional view, used in the wet mode operation of the system of this invention depicted schematically in FIG. 8.
Figure 9C:
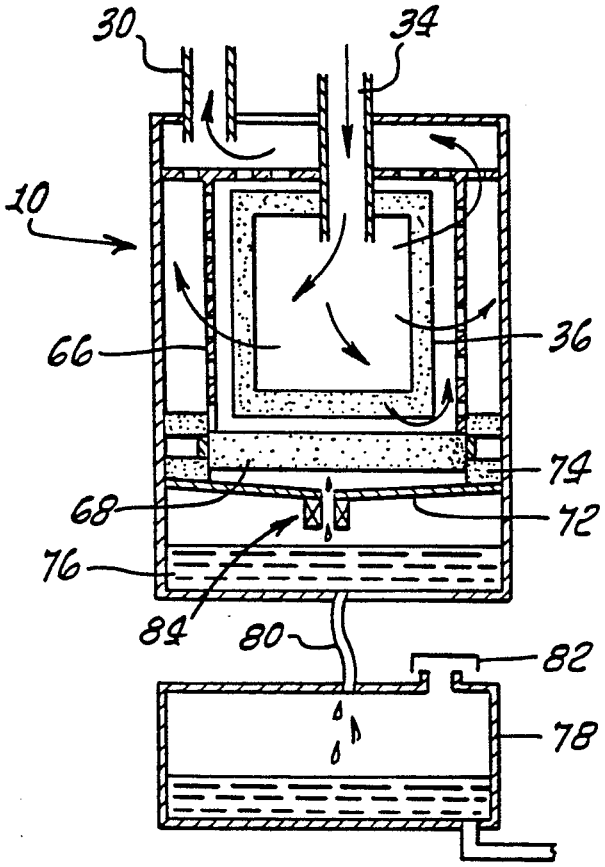
FIG. 9C shows the arrangement of FIG. 9B with the unit housing lid in place and further showing the vacuum line and the dirty air and atomized liquid filtering cycle and clean air return.
Figure 9B:
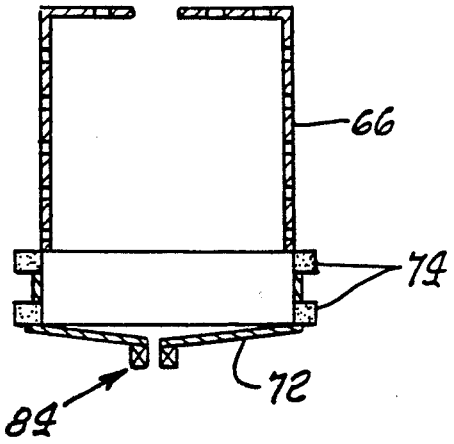
FIG. 9B shows the filter of FIG. 9A in conjunction with a separate removable filter housing, baffle, water chamber seal and one way valve.
Figure 10A:
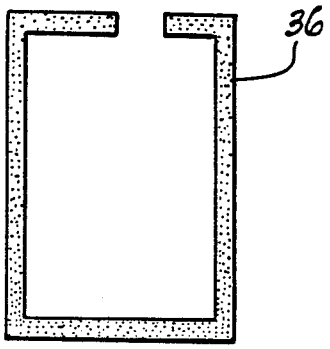
FIG. 10A shows in section view, a dry filter which is usable in the device of FIGS. 1 to 7.
Figure 10B:
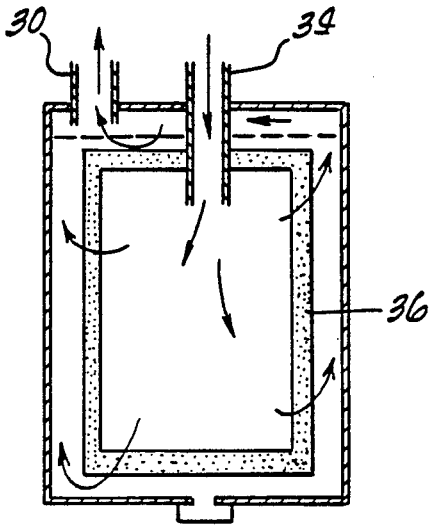
FIG. 10B shows the filter of FIG. 10A in conjunction with the filter unit housing, lid, vacuum line and dirty air filtering cycle and clean air return.
Figure 11:
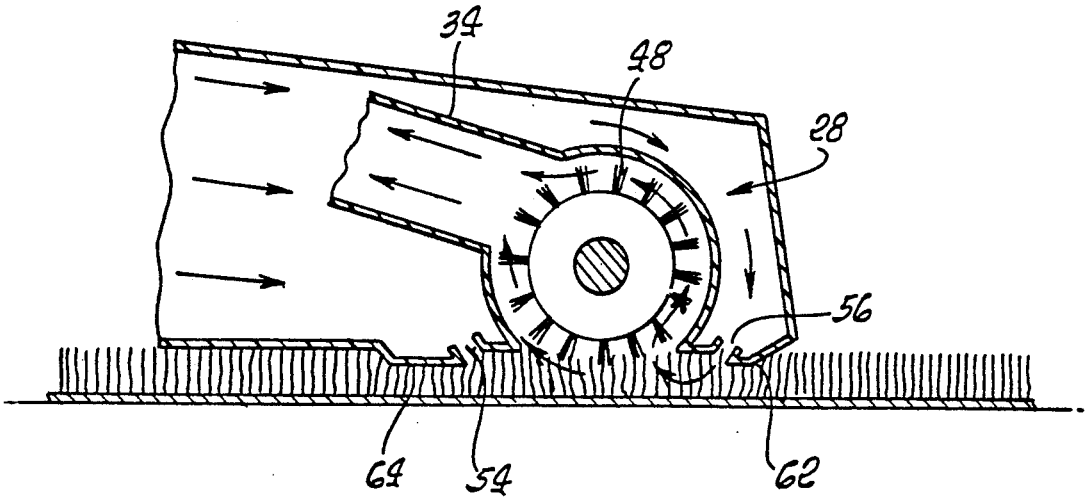
FIG. 11 shows a side view of the head assembly in schematic form and showing the air dams at the periphery of the head assembly to provide a closed loop airflow at the head assembly.

Turning to the wet mode, the filter assembly 36, which is of an air permeable material, is surrounded by separate removable filter housing 66. In FIG. 4, and FIGS. 9*a,b,c* the outer filter housing is the inside walls of the upper portion 10. The bottom portion 68 of the filter assembly 36 is separate, as shown in FIGS. 4 and 9. The filter assembly 36 is specifically designed to allow wet air filtering at high velocity with minimum airflow restriction and to separate air and liquids. The bottom portion 68 of the filter assembly 36 is specifically designed to perform the fine and precise filtering of the liquids (cleaning solutions) at low flow levels. These multiple stage filters may be construction as single or separate units. The filter assembly 36, removable filter housing 66 and bottom portion 68 are received in housing unit 10 provided with lid 26. The baffles 72, seals 74, and one way valve 84 of the separate wet filter housing 66 prevent the filtered liquid 76 from sloshing upwardly onto the filters. The filtered liquid 76 then passes to the main sealed and removable reservoir 78 via line 80. Reservoir 78 has a liquid fill cap 82. The filtered liquid flow in line 80 is adjustable by valve 88. The reservoir 78 is pressurized by pressurized air in line 86, the pressure in reservoir 78 being regulated by valve 88. In addition, the baffles 72, seals 74 and valve 84 serve to prevent backflow of filtered liquid 76 into filter assembly 68 and 36 and beyond, particularly when upper portion 10 is at or near the horizontal position shown in dotted lines in FIG. 4.

The venturi 90 functions like a carburetor to produce atomized cleaning liquid into the filtered air flow prior to insertion into head assembly 28 at slots 54 and 56. The dirty liquid is picked up via line 34 and returned to filter 36 where more complete condensation of the liquid takes place as shown. The flow of liquid venturi 90 via line 92 is regulated by valve 138 is operated by switch 24. It is to be understood that the cleaning liquid may contain detergents, germicides and disinfectants. The effect of bactericides is not only to sterilize the liquid, but also to scrub the air within the system of bacteria in a continuous closed loop manner, without exhausting into the atmosphere making this invention of special use in hospital and similar settings where patient exposure to bacterial contamination has been a serious chronic problem.

The removable wet filter housing assembly or (caddy) 66 is easily serviced by lifting the lid portion 26 and pulling it out of the outer housing 10 (see FIG. 4, 9*a*, 9*b* and 9*c*).

The unit of this invention is provided with wheels 96 at either side at the rear of the lower head assembly 28. By tipping the unit back toward the operator, it ia possible for the operator to wheel the unit to any desired location for use.

As shown in FIG. 4, the upright portion 10 can be moved or rotated from the vertical to the horizontal or any intermediate position to facilitate use of the unit in cleaning under furniture and other constricted and tight spaces. It should be noted that since the liquid is carried in the separate removable reservoir 78 attached to lower head assembly 28, the device has a low center of gravity and has no tendency to fall or tip over when stored or left unattended.

The operation of the device can be further described by reference to the schematic drawing of FIG. 8 to which we now turn.

The rotating brush 102 is contained within housing 104. The airflow slots 106 and 108 are at opposite sides to provide forward and backward operation as previously described. Valve 110 regulates the airflow between slots 106 and 108, motor 114 drives brush 102 via drive belt 116. The vacuum motor 118 exhausts pressurized air through line 120 which drives turbine motor 114. The dirty air is sucked out through line 122 to filter assembly housing 124. The filtered liquid 126 passes to the main reservoir 128 which is pressurized by air from line 130, controlled by one way air valve 132. The filtered liquid passes via line 134 to venturi 136 regulated by valve 138.

The optional pressure and air flow regulator valve 140 momentarily opens to admit air in the event there is a momentary air flow restriction to the vacuum motor 118 due to a momentary obstruction. By the automatic opening of valve 140, air continues to bs supplied to vacuum motor 118 and the exhaust air continues to drive the air turbine motor 114 which, in turn, continues to drive the brush 102.

The operation of this invention affords significant advantages as will be appreciated by those skilled in the art. The air and liquid flow is a closed loop system with continuous recycling made possible by filtering, the air dams and the injection of air from the vacuum motor. In this invention there is no air discharge or air exhaust external to the unit to stir up dirt, bacterial, and the like. This avoidance of any disturbance of the environment around the unit is a notable feature.

It is also important to note that the clean air and, if present, cleaning fluid is injected in a closed loop manner ahead of the brushes to help lift and remove the dirt and other material to be vacuumed away. This mode of operation substantially increases the efficiency of the unit over what is obtainable using the normal rotating brush device. Further, the unit cleans the rug or other surface when pushed either forward or backward in both dry and wet modes.

Figure 12:
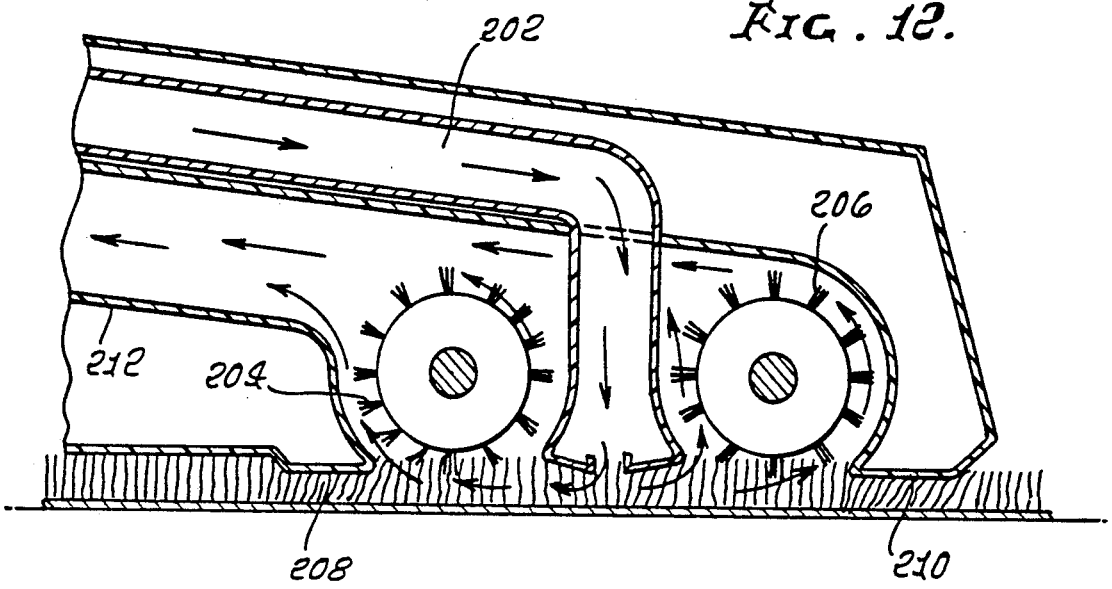
FIG. 12 is a schematic view of the head assembly provided with dual brushes for cleaning rugs in accordance with an alternative preferred embodiment of my invention.
Figure 13:
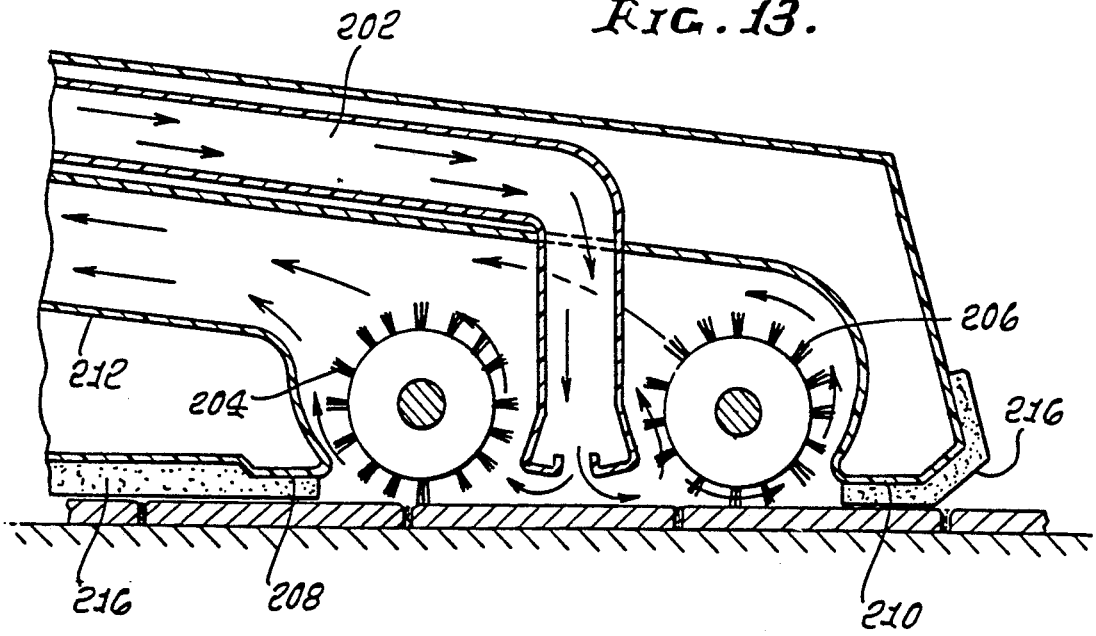
FIG. 13 is similar to FIG. 12 and shows the dual brush assembly in the wet mode of operation with scrub pads attached for cleaning hard surfaces and providing a flexible peripheral air dam that will maintain the seal on irregular surfaces.

As shown in FIGS. 12 and 13, the unit may have dual or tandem brushes. In FIG. 12, filtered air is introduced valve line 202 between brushes 204 and 206. The elements 208 and 210 act as peripheral air dams and function as previously described with reference to the single brush unit. The dirty air is drawn up via line 212. In the hard floor scrubbing machine of Picture 3, the scrub pad 216 clips onto the bottom of the unit and abut the surface being cleaned to help loosen adhered materials present on a hard surface. Scrub pad 216 also serves as a flexible peripheral air dam and is providing a flexible seal on irregular hard floor surfaces.

Figure 5:
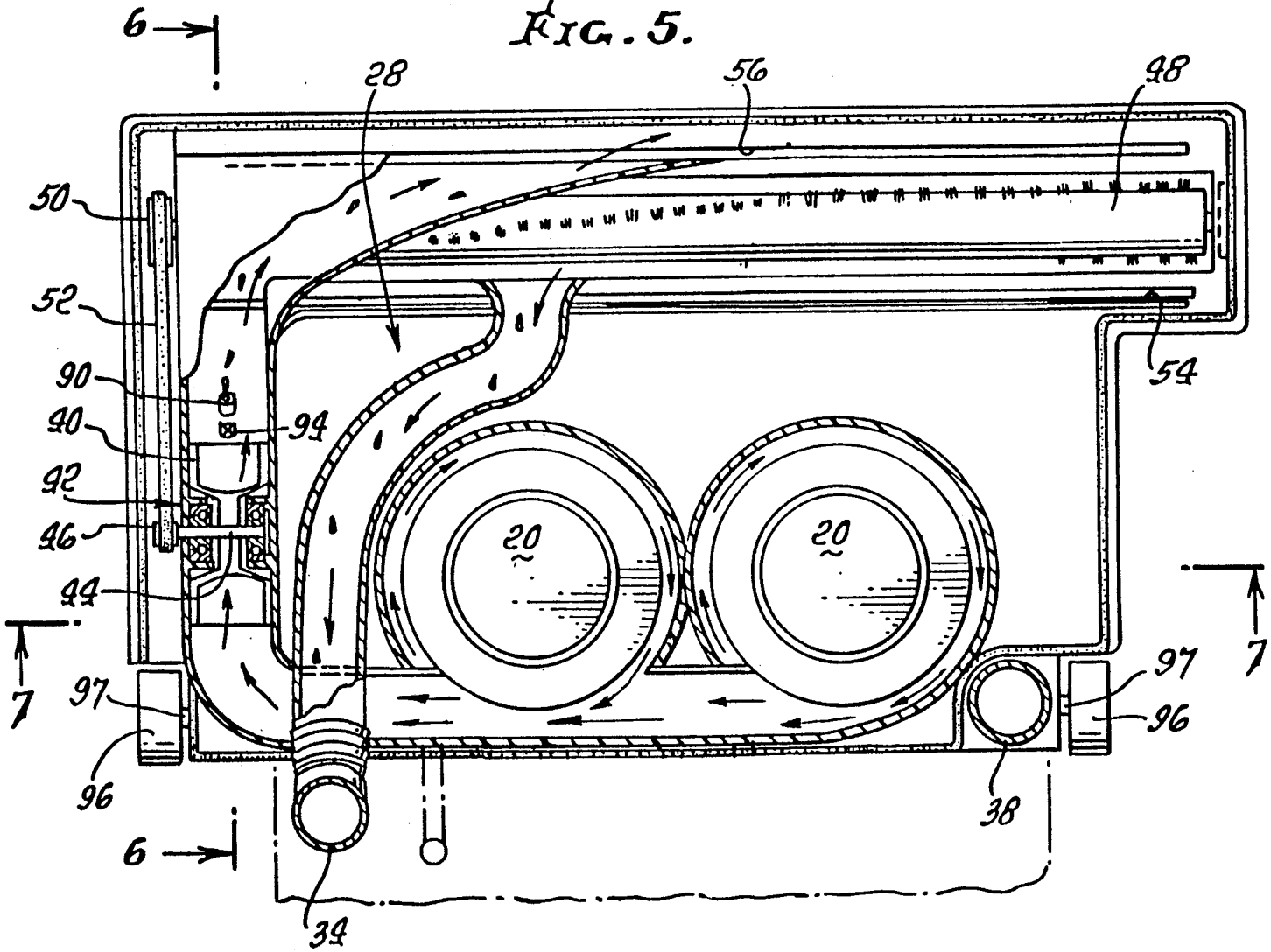
FIG. 5 is a top plan view, in partial breakaway, of the lower or head assembly portion of the device of FIGS. 1 to 4.
Figure 8:
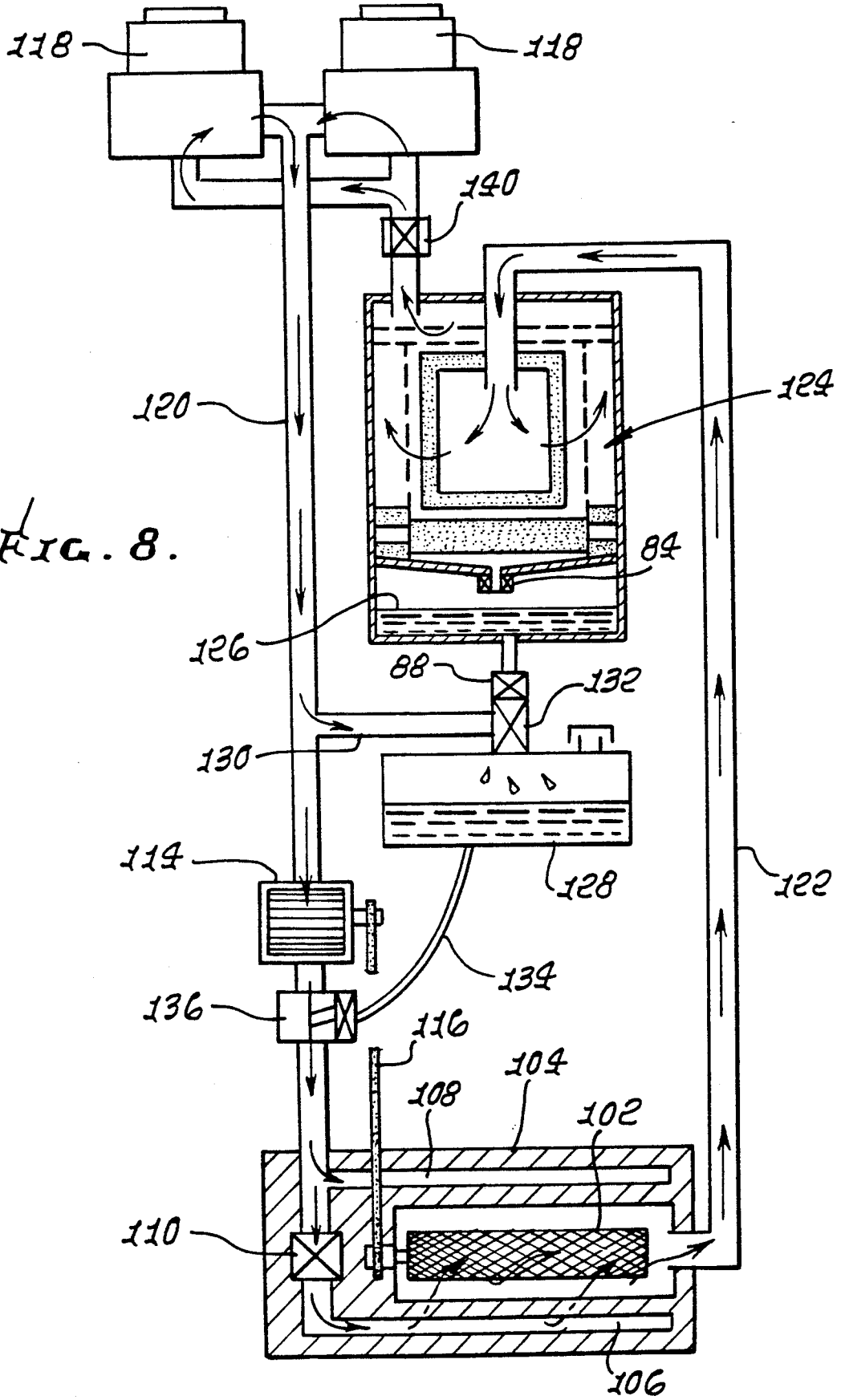
FIG. 8 is a schematic view showing the essential functional features of the present invention which can be present in the device pictured in FIGS. 1 to 7.

FIGS. 5, 7 and 8 show a preferred embodiment wherein two vacuum motors in parallel arrangement are provided. The parallel arrangement provides significant benefit in that the total vacuum and volume of air being moved is greatly increased, which enhances the cleaning efficiency of the overall machine.

Turning to the two embodiments of the flap valve 58, reference is made to FIGS. 14 to 18 in detail. The air flow directional flap valve 58 of FIG. 6 is engaged and activated by a unique instant-acting two-way (forwards and backwards) slip clutch unit in either all mechanical configuration, FIGS. 14 and 15A, or electro-mechanical configuration, FIGS. 15B, 16, 17 and 18. The mechanically operated embodiment of FIGS. 14 and 15A has a timing belt 300 on cogged wheels 302 and 304. The shaft 97 carries slip clutch unit 306. The slip clutch unit 306 is directly mounted to the wheel shaft 97 and wheel 96, FIGS. 5 and 6. The wheel or wheels 96 are fixed to the wheel shaft 97 and move rotatably as a unit when the vacuum cleaner moves forwards and backwards. This instantly activates the shaft mounted slip clutch assembly 306 in a forwards or backwards mode and in turn activates the flap valve assembly 58 in a forwards or backwards mode. In the case of the all mechanical means (FIGS. 14 and 15A) activation is by timing belt and pulleys, and in the case of electro-mechanical means (FIG. 15B, 16, 17 and 18), activation is by electrical switch and solenoid activation means.

When the flap valve 58 is activated by the slip clutch in either direction the rotational pressure supplied by the slip clutch and the high velocity air flow pressure impinging on the flap valve blade will keep the flap valve shut tight in either direction.

The slip clutch pressure adjustment feature is to adjust the pressure on the slip plate sufficiently to overcome any resistance of the flap valve during flap valve activation by the slip clutch system such as air flow pressure against the flap valve blade (approximately 4–6 psi) during operation, it further serves to adjust for wear.

Figure 14:
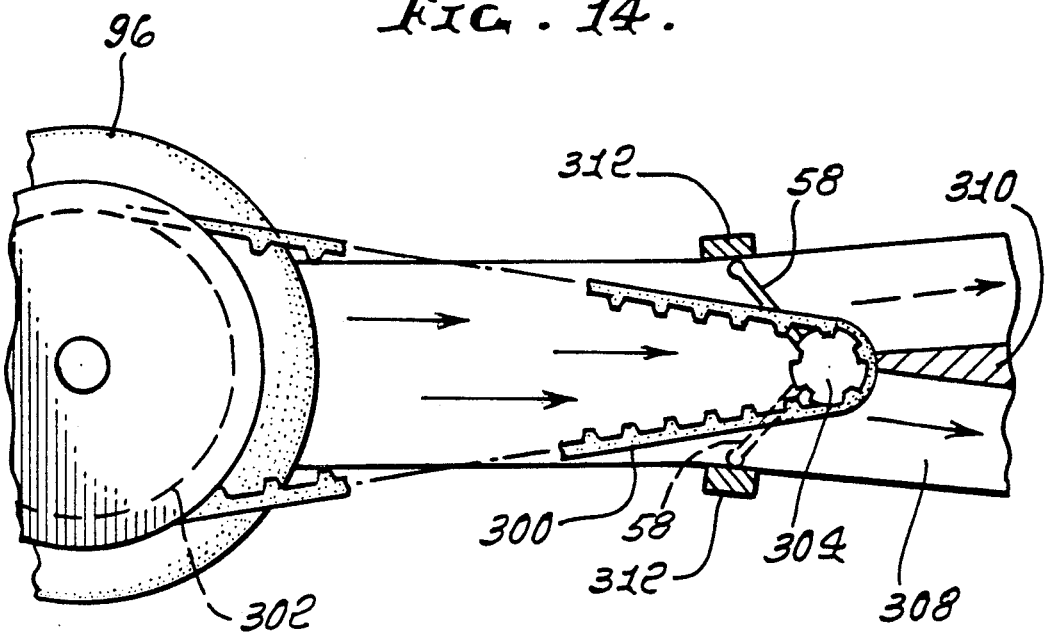
FIG. 14 is a side view of the mechanically activated flap valve system employed on a preferred embodiment of this invention.
Figure 15B:
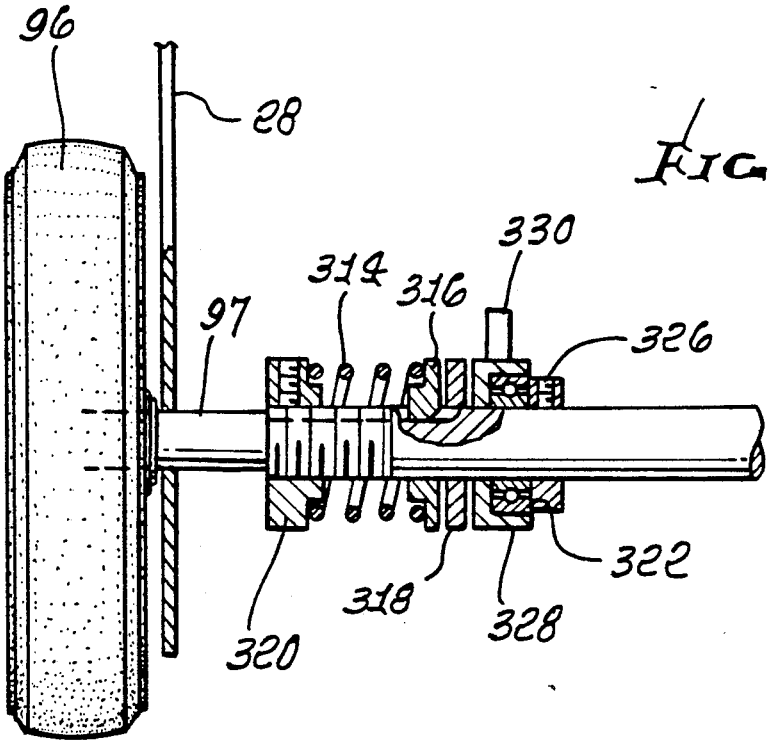
FIG. 15B is a cross-section of an electrically activated flap valve embodiment and related structure which is an alternate embodiment to FIG. 14.

In FIG. 14, the airflow is indicated by arrows. The airduct 308 has a divider 310. The valve seats 312 for the flap valve 58 provide a secure seal and cushion to limit wear.

In the embodiment of FIG. 15A, the actuation of the toothed timing belt 302 is provided by the spring 314, pressure plate 316 and slip plate 318 The slip plate 318 is made of a solid self-lubricating material such as Teflon. The degree of spring pressure or bias exerted by spring 314 and pressure plate 316 on slip plate 18 is determined by the location setting of the spring pressure adjusting knob 320 which is threadably received on shaft 97. The toothed timing belt pulley 302 is carried on thrust bearing 322 and housing thrust bearing 324 so that the amount of rotational force delivered to the flap 58 is limited. The bearing 322 is retained by collar and set screw 326.

Figure 16:
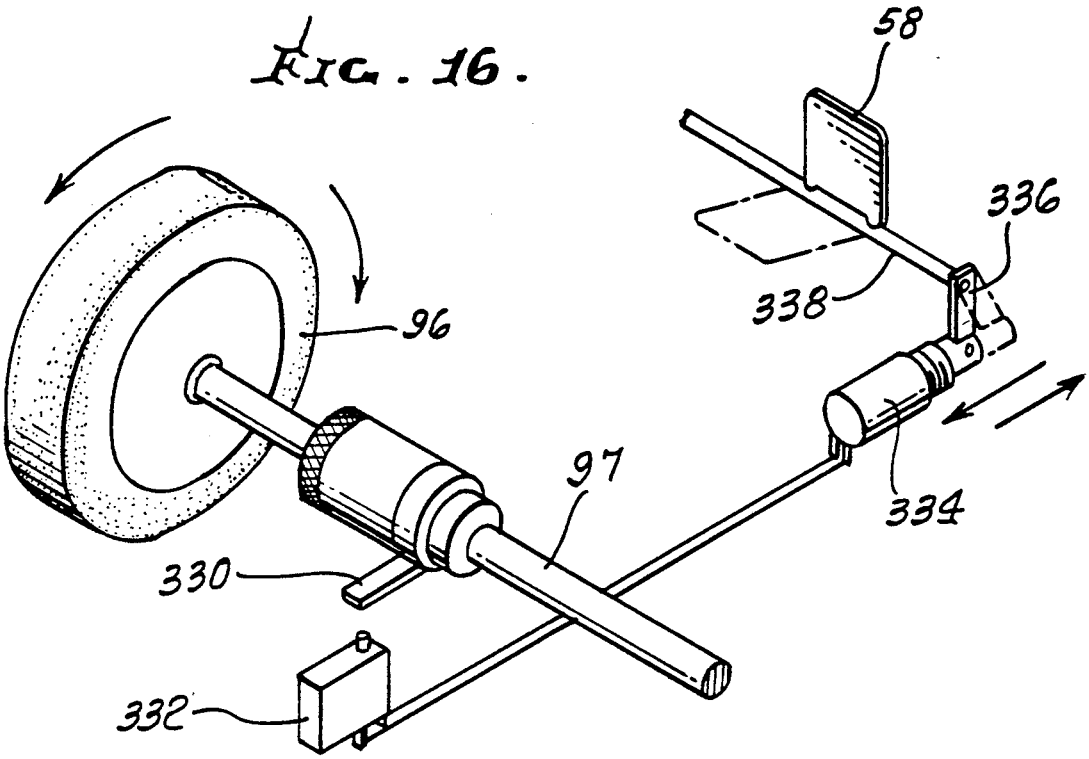
FIG. 16 is a perspective view of the elements involved in the electrically operated flap valve of FIG. 15B.
Figure 17:
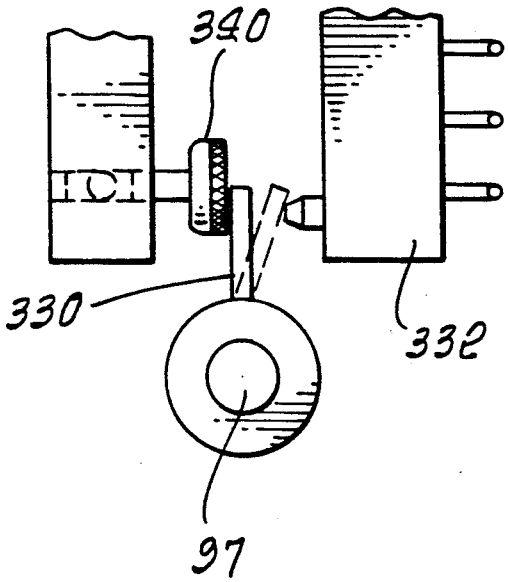
FIG. 17 is an enlarged schematic drawing of the back and forwards operated switch assembly (travel adjustment) for the flap valve system of FIG. 16.

In the electrically actuated system of FIGS. 15B through FIG. 18, the toothed timing belt pulley is replaced by the housing thrust bearing 328 which has the electrical switch activating arm 330. The operation of the system is as shown in FIGS. 16 and 17. The switch activating arm 330 opens and closes the switch contact 332 which operates two way solenoid 334 and acts as a flap valve reversing switch. The solenoid 334 operates activating arm 336 which in turn operates pivot arm 338 carrying flap valve 58. The dotted lines indicate the forward mode and the solid lines the backward mode or vice versa. The adjustment knob 340 limits the travel of arm 330.

The overall configuration of the vacuum unit of this invention may be, but is not limited to, the following:

For home use, the configuration may be a trailing canister-type unit with hoses and wand, or in a single push—and-pull upright unit configuration, or it may be in a portable hand-held or body mounted and carried configuration.

For industrial use, it may be as in the above-described configuration, and in addition, for large capacity units, it may be truck, car or cart mounted, to facilitate cleaning large industrial areas.

The novel configuration of the filtering system provides various filtering capabilities in the same outer container.

The dry filtering mode utilizes a dry disposable or permanent filter, which may be constructed of various materials to provide a variety of filtering levels, and is installed directly into the outer housing.

The wet filtering mode utilizes a separate and removable inner housing containing the wet disposable or permanent filter unit. The inner housing is then inserted into the same outer housing as in the dry configuration. The inner housing is novel, in that it provides the following functions:

1. Containing the special separate high velocity air filtering and water separation unit.

2. Containing the special separate water filter with highly efficient (low micron) filtering capabilities at low liquid flow levels without having to process the air flow.

3. Handling air, dirt, and water separation at high airflow velocities, and liquid filtering at low flow levels, within the same outer housing, without detrimental effect to each other.

4. Creating separate cavities within the outer housing to handle the high velocity air filtering and water separation in one cavity, and the highly efficient water filtering at low flow levels in another cavity.

5. Creating a separate cavity within the outer housing to collect the clean filtered solution for reuse and dispensing.

6. Removability of the wet inner filter housing and ease of servicing wet inner filter housing external to the outer housing.

7. Removability of inner housing and ease of servicing outer housing when inner housing is removed.

8. Controlled wall operation of the inner and outer housing, providing greater air flow through and around the filter unit, resulting in greatly improved filter efficiency.

Accessories for this cleaning unit will depend on each unit's final configuration as described in detail in this document.

All configurations will have the proper provisions to install and use the accessories designed to serve the individual unit configuration.

The accessories include, but are not limited to, the following:

FOR WET APPLICATIONS 1. upholstery tool;
2. blow tool (for cleaning stopped-up sinks, et cetera);
3. suction tool (for cleaning stopped-up sinks and toilets);
4. hand-held cleaning unit (which may or may not be motorized). (For general use in odd places.)

FOR DRY APPLICATIONS 1. crevice tool;
2. curtain brush tool;
3. window-blind brush tool;
4. brush tool (general use);
5. hand-held cleaning unit (which may or may not be motorized). (For general use in odd places.)

In larger units, two brushes can be provided within the head assembly with the dual brush configuration. The air jet release system is placed in the center of the dual brush configuration with brush assemblies and vacuum opening on each side of the air jet release system, which eliminates the need for an air flow valving system as described and needed in the single brush assembly design. The air flow from the now centrally-located air jet release system is captured traveling in either direction automatically.

Having fully described the invention, it is intended that it be limited solely by the lawful scope of the appended claims.

I claim:

1. A vacuum system having a closed air flow loop for cleaning rugs and floor or other surfaces which comprises:

a) a vacuum source having a suction side and a controlled air flow pressure side (exhaust side);
b) a pair of spaced apart wheels positioned at the rear of said vacuum system and adapted to ride on the surface to be cleaned;
c) a head assembly positioned in said system forwardly of said pair of spaced apart wheels and adapted to ride on the rug or floor or other surface to be cleaned in order to form said closed air flow loop;
d) at least one rotatable brush within said head assembly;
e) means of communicating the suction side of the vacuum source with the head assembly to provide suction within said head assembly for picking up dirt or other materials;
f) a turbine motor;
g) means communicating the air exhaust side of the vacuum source with said head assembly, said turbine motor being positioned within said means whereby the air exhaust impinges on and drives the turbine motor;
h) means interconnecting the brush and the turbine motor whereby the turbine motor drives the brush, said means interconnecting being at a right angle to the axis of rotation of the brush; and
i) peripheral air containment means associated with said head assembly for preventing air from entering or leaving around the periphery of said head assembly when it rides on said surface to be cleaned.

2. The system of claim 1 wherein the air is injected into said head assembly and onto said surface to be cleaned to agitate dirt and facilitate dirt removal.

3. The system of claim 1 wherein air filter means is positioned between the suction side of the vacuum source and the head assembly to remove dirt and other solid, liquid or other particulate material in a closed loop manner.

4. The system of claim wherein there is additionally provided a cleaning liquid source and means for the injection of atomized liquid into said head assembly.

5. The system of claim 4 wherein the means for injection includes a venturi.

6. The system of claim 4 wherein the liquid may contain germicidal and bacterial killing compounds for removal of germs and bacteria from the surfaces to be cleaned and continuous scrubbing of the liquid and air within the unit system in a closed loop manner.

7. The system of claim 4 wherein air filter means is positioned between said vacuum source and said head assembly to remove dirty atomized liquid to form a condensate; and means for communicating said filtered clean condensate with said means for injecting atomized liquid.

8. The system of claim 10 embodied in a self-contained, upright cleaner configuration comprising an upright portion and a head assembly portion carrying said vacuum source and said cleaning liquid source, said upright portion being rotatable from the vertical position to the horizontal position for use in vacuuming under furniture and the like, said upright portion containing means to prevent backflow of cleaning liquid into said air filter means when said upright portion is in the horizontal position.

9. The system of claim 1 wherein there are a plurality of brushes.

10. The system of claim 1 including further air directing means within said head assembly for forcing the air through the tufts of the rug being cleaned.

11. The system of claim 1 wherein said means interconnecting the brush and the turbine motor includes pulleys and a drive belt.

12. The system of claim 1 wherein the means for communicating the exhaust side of the vacuum source with said head assembly to inject air into said head assembly is positioned so that the air is alternately injected ahead of the said brush in both directions.

13. The system of claim 1 wherein the means for communicating the suction side of the vacuum source with the head assembly to provide suction within said head assembly for picking up dirt and other material is positioned so that suction is available over said brush in both dry and wet mode.

14. The system of claim 1 wherein said means for interconnecting the brush and the turbine motor is at one end of the brush.

15. The system of claim 1 wherein there are a plurality of vacuum motors.

16. The system of claim 1 further including means to alternately inject air at opposite sides of said brush so that the said unit can be used to clean when moving forward and backward.

17. A vacuum system for cleaning rugs and floor or other surfaces having a closed loop for both the air and the cleaning liquid to continuously recirculate and filter the air and sanitize the cleaning liquid which comprises:

a) a vacuum source having a suction side and a controlled air flow pressure side (exhaust side);

b) a pair of spaced apart wheels positioned at the rear of said vacuum system and adapted to ride on the surface to be cleaned;

c) a head assembly positioned in said system forwardly of said pair of spaced apart wheels and adapted to ride on the rug or floor or other surface to be cleaned in order to form said closed air flow loop;

d) at least one rotatable brush within said head assembly;

e) means of communicating the suction side of the vacuum source with the head assembly to provide suction within said head assembly for picking up dirt or other materials;

f) a turbine motor;

g) means for communicating filtered air exhaust side of the vacuum source with said head assembly, said turbine motor being positioned within said means whereby the air exhaust impinges on and drives the turbine motor;

h) means interconnecting the brush and the turbine motor whereby the turbine motor drives the brush, said means interconnecting being at a right angle to the axis of rotation of the brush;

i) a liquid source and means for the injection of atomized liquid into said head assembly ahead of said brush, said liquid may contain germicidal and bacterial killing compounds for removal of germs and bacteria from the surfaces to be cleaned and continuous scrubbing of the liquid and air within the unit system;

j) air containment means including air dams provided around the periphery of said head assembly for preventing air from entering or leaving said head assembly when it rides on said surface to be cleaned;

k) air filter means positioned between the vacuum source and the head assembly to remove dirty atomized liquid to form a condensate;

l) means for filtering said condensate; and 1) means for communicating said filtered clean condensate with said means for injecting atomized liquid.

18. The system of claim 17 wherein there are a plurality of brushes.

19. The system of claim 17 including further air directing means within said head assembly for forcing the air through the tufts of the rug being cleaned.

20. The system of claim 17 wherein said means interconnecting the brush and the turbine motor includes pulleys and a drive belt.

21. The system of claim 17 embodied in a self-contained, upright vacuum cleaner configuration comprising an upright portion and a head assembly portion carrying said vacuum means and said cleaning liquid source, said upright portion being rotatable from the vertical position to the horizontal position for use in vacuuming under furniture and the like, said upright portion containing means to prevent backflow of cleaning liquid into said air filter means when said upright portion is in the horizontal position.

22. The system of claim 17 wherein said means for connecting the brush and the turbine motor is at one end of the brush.

* * * * *